US006041556A

United States Patent [19]

Keller

[11] Patent Number: 6,041,556

[45] Date of Patent: Mar. 28, 2000

[54] GUTTER SYSTEM

[76] Inventor: Peter S. Keller, Box 4037 Judith's Fancy, Christiansted, St. Croix, Virgin Islands

[21] Appl. No.: 08/923,481

[22] Filed: Sep. 4, 1997

[51] Int. Cl.[7] ..... E04D 13/00

[52] U.S. Cl. ..... 52/11; 52/12; 52/16

[58] Field of Search ..... 52/11, 12, 16; 285/423

[56] References Cited

U.S. PATENT DOCUMENTS

| | | | |
|---|---|---|---|
| 274,393 | 3/1883 | Schaffert . | |
| 603,611 | 5/1898 | Nye . | |
| 618,797 | 1/1899 | Manrow . | |
| 836,012 | 11/1906 | Cassen . | |
| 1,870,963 | 8/1932 | Pierose . | |
| 3,367,070 | 2/1968 | Mitchell . | |
| 3,752,593 | 8/1973 | Fitzgerald et al. . | |
| 4,455,791 | 6/1984 | Elko et al. . | |
| 4,493,588 | 1/1985 | Duffy . | |
| 4,497,146 | 2/1985 | Demartini . | |
| 4,506,479 | 3/1985 | Matthison-Hansen . | |
| 4,571,896 | 2/1986 | Condie . | |
| 4,580,934 | 4/1986 | McCormick . | |
| 4,586,408 | 5/1986 | Goldner . | |
| 4,693,643 | 9/1987 | Heyworth . | |
| 4,720,219 | 1/1988 | Masonek et al. . | |
| 4,757,649 | 7/1988 | Vahldieck . | |
| 4,779,902 | 10/1988 | Lee | 285/423 |
| 4,798,028 | 1/1989 | Pinion | 52/16 |
| 4,858,396 | 8/1989 | Rose et al. . | |
| 4,889,454 | 12/1989 | Hillestad et al. . | |
| 4,975,001 | 12/1990 | Rabo et al. . | |
| 5,000,629 | 3/1991 | Nygards . | |
| 5,007,778 | 4/1991 | Hillestad et al. . | |
| 5,013,193 | 5/1991 | Rabo et al. . | |
| 5,016,404 | 5/1991 | Briggs . | |
| 5,099,620 | 3/1992 | Carey . | |
| 5,261,196 | 11/1993 | Buckenmaier et al. . | |
| 5,314,270 | 5/1994 | Lavancy et al. . | |
| 5,427,417 | 6/1995 | Lechuga | 52/16 |
| 5,427,477 | 6/1995 | Weiss . | |
| 5,437,138 | 8/1995 | Tuohey et al. | 52/741.1 |
| 5,497,583 | 3/1996 | Rhoads | 52/12 |
| 5,738,388 | 4/1998 | Sundelin | 285/423 |

FOREIGN PATENT DOCUMENTS

| | | | |
|---|---|---|---|
| 1222227 | 8/1966 | Germany | 52/11 |
| 4204628 | 9/1992 | Germany | 52/16 |

*Primary Examiner*—Carl D. Friedman
*Assistant Examiner*—Dennis L. Dorsey
*Attorney, Agent, or Firm*—Knobbe, Martens, Olson & Bear, LLP

[57] ABSTRACT

A gutter system employs a tube such as PVC pipe to fit over the edge of a roof so that part of the roof resides within the interior of the tube. One or more fasteners such as screws secure the position of the tube. In a preferred embodiment, a first drainage spout connected to the tube collects water and other debris which can be drained out of the spout by removing a cap which is preferably located at the bottom of the spout. A second drainage spout is connected to the first and acts as an overflow spout when the first drainage spout is full.

8 Claims, 6 Drawing Sheets

GUTTER SYSTEM

BACKGROUND OF THE INVENTION

This invention relates to a gutter system for collecting water runoff from a roof, and particularly to a practical, reliable system that has a number of advantages.

There are several devices in the prior art designed to collect and channel water as it flows off of a roof. These devices, known as eaves, troughs or more commonly as gutters, are commonly used on residential dwellings to prevent water from accumulating too much in any one spot on the ground where it might damage the foundation of the building or a yard that surrounds the building.

U.S. Pat. No. 274,393 to Schaffert discloses a gutter comprising a trough of semi-circular cross section that extends partially underneath the eaves. A hinged cover of larger semi-circular cross section extends over the top edge of the roof. The eaves-side of the trough is secured to metal brackets and to a shank, which are in turn secured to the roof. The hinged end of the cover is located away from the house and is supported with a brace bar. Metallic blocks raise the hinged cover off the roof to allow water to flow into the gutter.

U.S. Pat. No. 3,367,070 to Mitchell discloses a mesh wire strip that acts as a gutter protector for use over a conventionally suspended gutter. The protector is held in place with spaced curled brackets or "spring clamps", which press the mesh strip to the roof and curl down around the gutter. The mesh strip prevents large debris from entering the gutter while allowing water to pass through.

U.S. Pat. No. 4,506,479 to Matthison-Hansen discloses a grooved roof with a member for mounting gutter brackets designed to support an uncovered trough.

U.S. Pat. No. 4,571,896 to Condie discloses a gutter assembly in which an elongated, preferably transversely flexible sheet extends down from the edge of the roof into a narrow slot within the gutter so that only water is directed into the gutter.

U.S. Pat. No. 4,858,397 to Rose et al. discloses a plastic trough with a longitudinal slot at its apex and an integral flat extension that passes underneath the eaves. The extension leads rain water into the slot at the apex of the trough.

U.S. Pat. No. 5,497,583 to Rhoads discloses a tubular plastic rain gutter with a specially formed longitudinal slot in that portion of the gutter facing away from the building. A flashing member leads water from the roof to the outside upper surface of the gutter. The water is directed along the edge of the gutter and into the slot by surface tension.

Gutters in the prior art, however, tend to be elaborately constructed, or have water runoff from the roof channeled indirectly into the gutter. A need still exists for a system that is inexpensive, practical, and attractive.

SUMMARY OF THE INVENTION

In accordance with the invention, a simple, readily available, preferably plastic tube is provided with a longitudinal slot that fits onto the edge of a roof so that a portion of the roof resides within the tube. Water runoff from the roof passes directly through the slot into the tube to be channeled away. At least one fastener is employed for fixing the position of the tube with respect to the roof, in which the fastener passes through the exterior of the tube to secure the roof within the tube's interior. Screws or nails can be used as fasteners, and PVC pipe works well as the tube. If the roof's upper surface is not flat, the water can flow directly into the tube through the natural channels of the roof without further provision needed. If the roof is flat, flowtabs may be placed between the roof and the tube to permit the runoff to enter the tube.

In another aspect of the invention, a first downspout is used to collect rainwater and debris such as twigs and leaves from a gutter. The first downspout includes a removable cap on its lower end to drain debris that collects within the spout. A second downspout that includes a section adjoining the first downspout is oriented such that the second downspout receives water overflow when the first spout is full, while heavier debris tends to continue to fall into the first spout until the first is substantially full of debris; the first spout thus acts as a debris collector while the second spout acts as a water overflow spout.

Another aspect of the present invention is a method of collecting fluid runoff from a roof. The method comprises the steps of positioning a tube having a longitudinal slot over an edge of a roof, so that the roof passes through the slot and the edge of the roof resides within the interior of the tube, securing the tube to the roof with at least one fastener, and receiving fluid runoff into the tube as it flows off the roof. In a preferred method, the securing step comprises passing the fastener through the exterior of the tube into the tube's interior to fix the position of the tube.

One advantage of the invention is that it can be used with roof surfaces that are either flat or corrugated. Another advantage of the invention is its ease of construction. Yet another advantage of the invention is that it can be either installed as a retrofit on an existing structure or integrally fabricated with the roof while the roof is constructed. Long lengths of tubing may be simply cut to length on the building site. Plastic connectors may be conveniently utilized to join pipe sections using well-known gluing techniques. Also, the ends of the sections and the connectors are preferably formed with end recesses that provide a smooth, attractive, constant exterior diameter and a smooth constant interior diameter. The invention is especially well-suited for areas receiving a large quantity of rainfall, e.g. the tropics, as well as for larger buildings with large surface areas.

DETAILED DESCRIPTION OF THE PREFERRED EMBODIMENT

Figure 1:
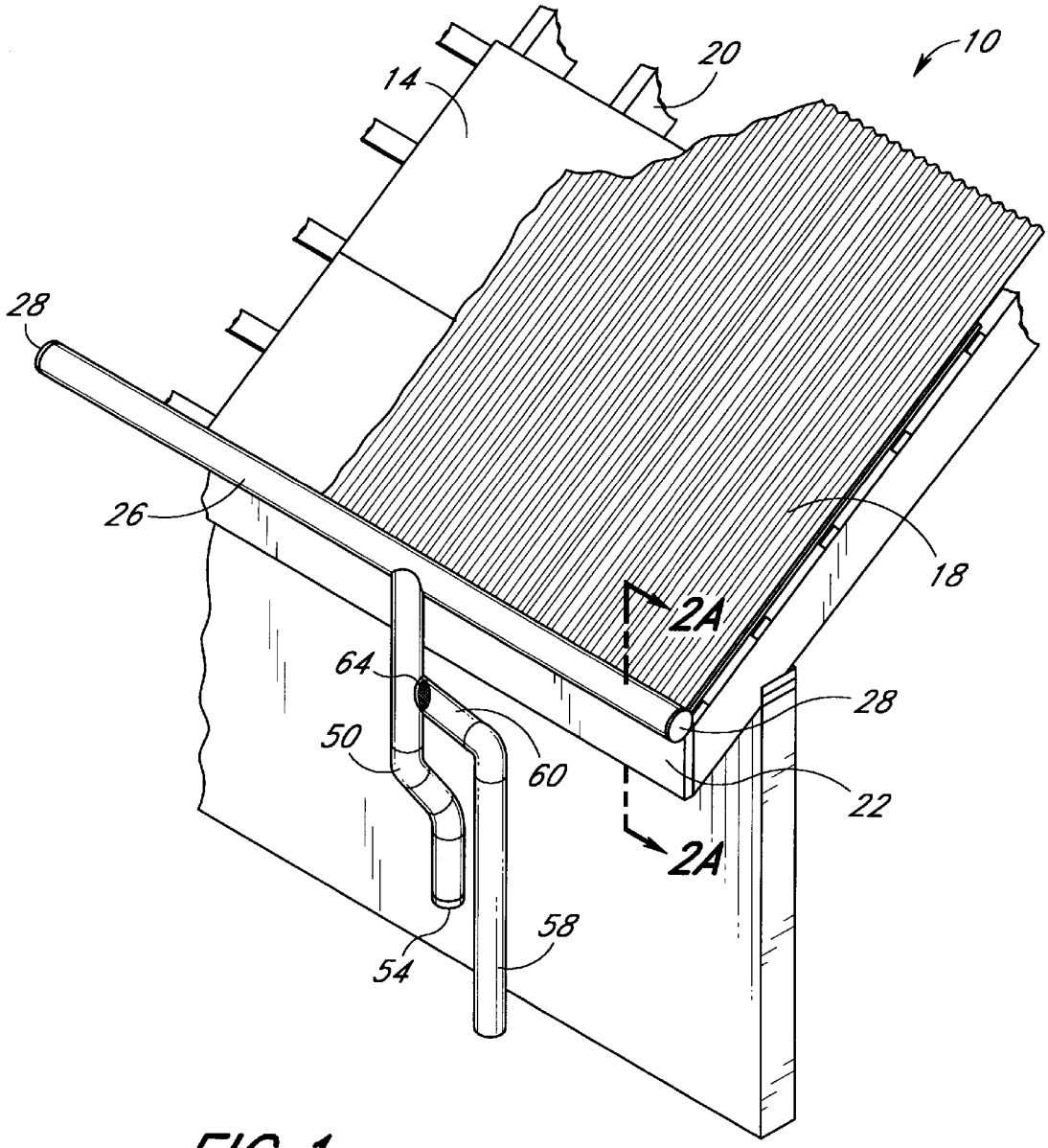
FIG. 1 is a perspective view of one embodiment of the invention, in which rainwater from a house is collected from its roof.

One embodiment of the invention is shown in FIG. 1, in which a roof 10 that overhangs a building or other structure is exposed to rainwater or some other fluid, resulting in fluid runoff down towards one or more edges of the roof. The roof 10 may include a decking 14, which may comprise wood or a wood-like material such as plywood, as well as a covering 18 that overlies part or all of the decking. The covering 18 may comprise sheet metal, corrugated metal, shingles, or a shingle-like material. The roof 10 may further include a number of rafters 20 that underlie the decking 14. Fascia board 22 extending in the vertical direction may abut the roof 10 near its edge.

Figure 2A:
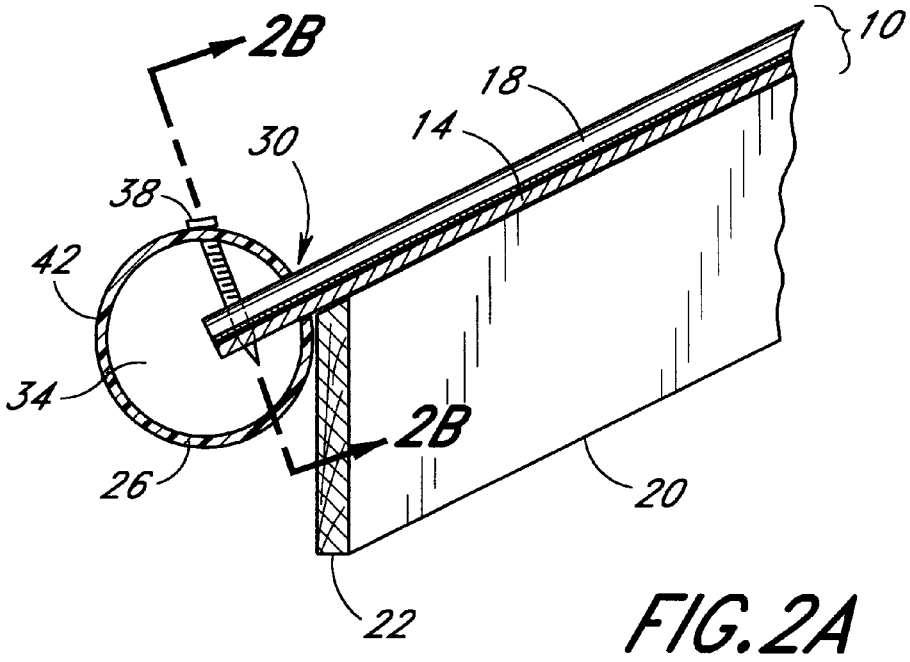
FIG. 2A is a transverse cross sectional view on line 2A—2A of FIG. 1 illustrating a fastener securing a gutter tube to the roof.
Figure 3A:
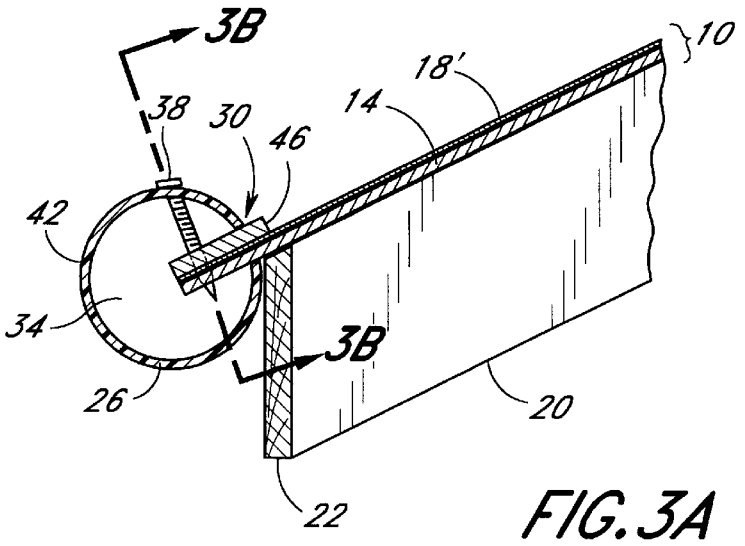
FIG. 3A is a transverse cross sectional view of another embodiment of the invention, in which flowtabs separate a tube from a flat roof to enable rainwater to flow directly into the tube.
Figure 3B:
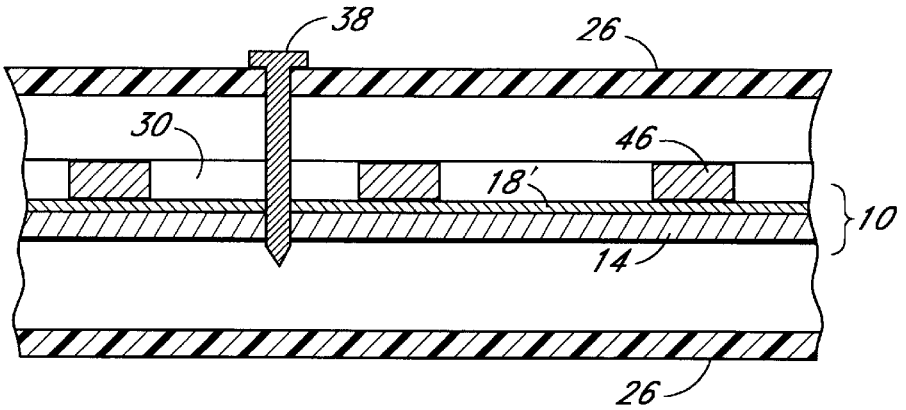
FIG. 3B is a longitudinal cross sectional view of the embodiment illustrated in FIG. 3A.
Figure 3C:
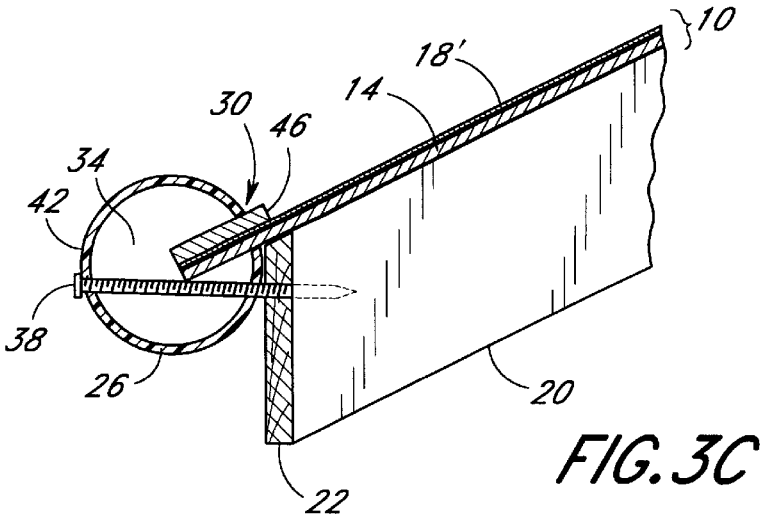
FIG. 3C is a cross sectional view of an alternate means for fastening a gutter tube to a roof.

FIG. 2A illustrates a tube 26 through which the fluid runoff is carried away. The tube 26 is preferably PVC with a convex, outwardly facing surface (e.g., circular in cross section) and a smooth interior and exterior, and may be, for example, 4", 6" or 12" in diameter. (Endcaps 28 attached to either end of tube 26 with screws may also be used, as shown in FIG. 1.) Tube 26 has a slot 30 therein along its longitudinal axis (typically 1.5" wide for a 4" diameter tube), permitting the roof 10 to pass though the slot and into the interior 34 of the tube 26. One or more fasteners 38 pass through the exterior 42 of tube 26 into its interior 34 where they secure the position of the tube with respect to the roof 10, penetrating (into or through) the roof itself. Alternatively, the fasteners 38 may pass all the way through the tube 26 and into the fascia board 22 and a rafter 20, with or without passing through the roof 10, as seen in FIG. 3C. The fasteners 38 are preferably screws, but nails and the like may also be used to join the tube 26 to the roof 10; they are preferably located in line with rafters 20 to provide maximum support. The tube 26 could be attached by external straps or other means, but a clean exterior appearance of the tube and the roof 10 is preferred.

Figure 2B:
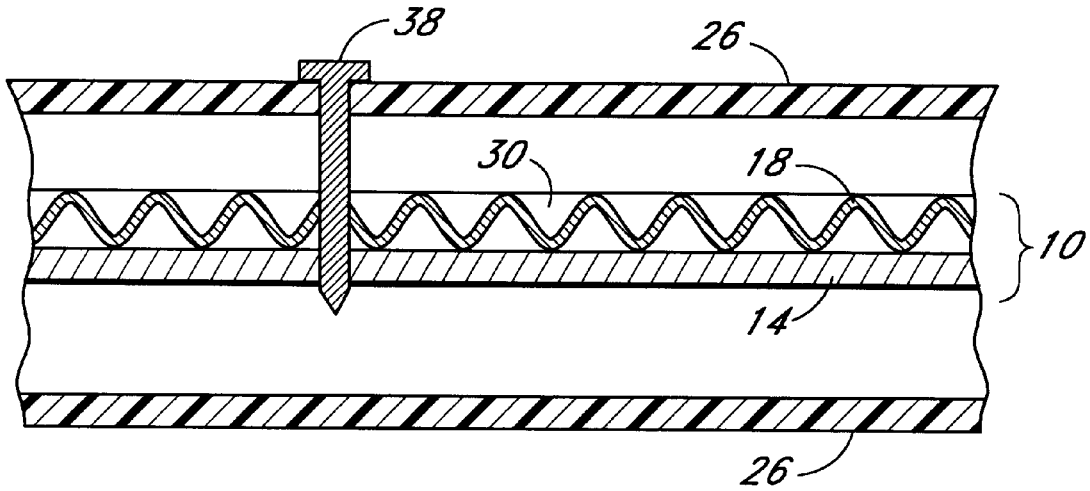
FIG. 2B is a longitudinal cross sectional view on line 2A—2A of FIG. 2A.

A longitudinal cross section of this embodiment is shown in FIG. 2B, in which the covering 18 is made of corrugated material. When the roof 10 is made of corrugated material, the fluid runoff collects in the troughs of that corrugated material and is channeled into the tube 26. Likewise, if the roof 10 includes periodically spaced metal ridges, as in the case of a standing seam metal roof, fluid runoff is channeled into the tube 26. However, if the roof 10 is not corrugated (e.g. a plywood roof, in which the covering 18' is substantially flat) or does not otherwise permit the flow of fluid into the tube 26, flowtabs 46 may be glued or tacked down at intervals along the tube as shown in FIG. 3A, so that fluid can pass between the flowtabs into the tube. FIG. 3B illustrates this arrangement, in which the fluid runoff is channeled through the spaces between flowtabs 46 before being carried away in the tube 26. The flowtabs 46 are preferably PVC and can be 3" wide by 5" deep by ¾" high. They are preferably smoothly contoured to promote the flow of fluid into the tube.

As shown in FIG. 1, the gutter system further comprises a debris collecting drainage spout (downspout) 50 connected to the tube 26. The spout 50 is oriented sufficiently steeply with respect to the tube 26 that debris (e.g., leaves and twigs) and fluid within the tube collects in spout 50. The spout 50 and the tube 26 are preferably connected by a tee or elbow fitting so that they are oriented at a right angle with respect to each other and the debris collecting spout is vertical. A removable cap 54 closes the lower end of the spout 50 and can be removed to clean out debris and fluid that collects in the spout, e.g. after a rainstorm.

An overflow drainage spout (downspout) 58 receives the drainage when spout 50 is full. The overflow spout 58 includes a section 60 that preferably runs nearly horizontally with respect to ground. In many situations, a roof will have some debris on it before a rainstorm starts. This debris will tend to be washed off first and will flow into the then empty debris spout 50. Further, even after the debris spout 50 is filled with water, heavier debris will continue to fall into the debris spout, displacing water into the overflow spout 58. A screen 64 may be optionally placed between the debris collection spout 50 and the overflow spout 58 to ensure that larger pieces of debris remain within spout 50. A screen mesh size of 0.25" may be used for this purpose.

Tube 26 may be constructed from shorter segments of PVC pipe suitably coupled together. In another aspect of the invention, the outer diameter of a recessed portion in one segment mates with the inner diameter of a recessed portion in an adjacent segment to form a relatively tight joint that can then be sealed with respect to liquids using, for example, readily available glue or epoxy.

Figure 4A:
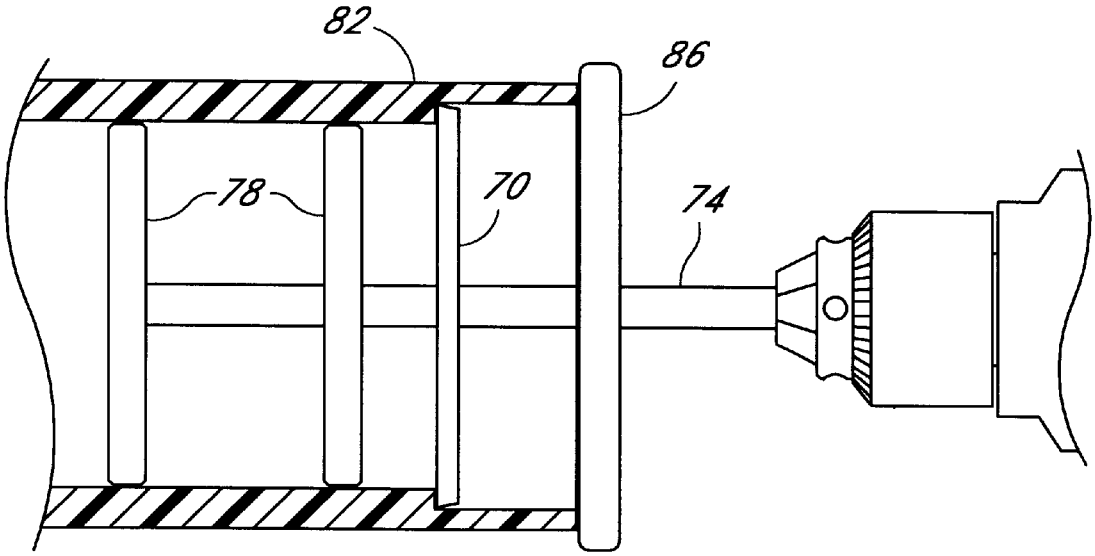
FIG. 4A is a longitudinal cross sectional view of a cutting tool as it bores out a tube to give it a recess of a desired inside diameter.
Figure 4B:
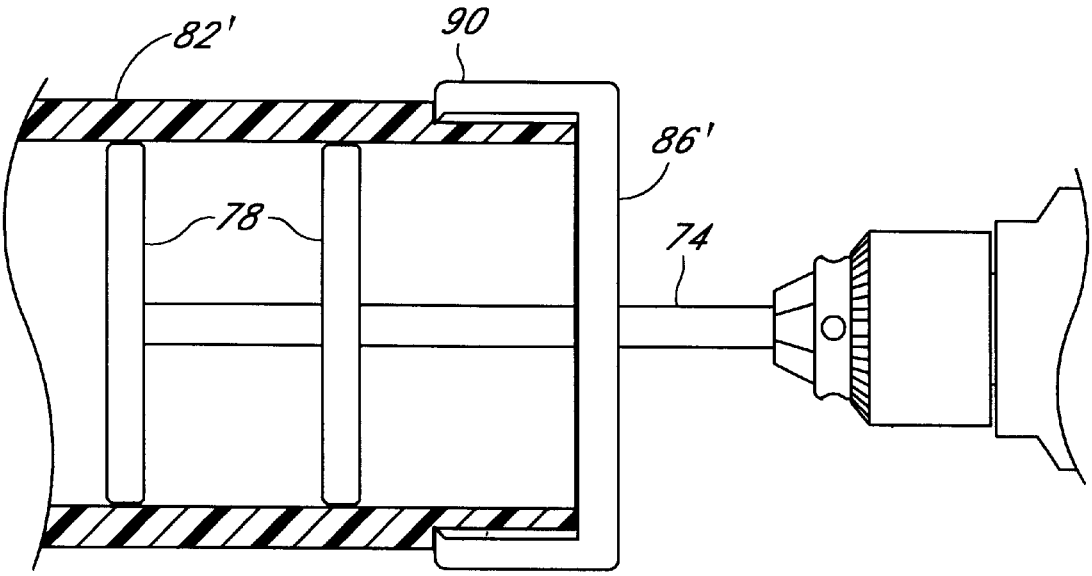
FIG. 4B is a longitudinal cross sectional view of a cutting tool as it shaves the exterior of a tube to give it a recess of a desired outside diameter.

A preferred method for constructing segments of PVC pipe to form a gutter system uses the tools illustrated in FIGS. 4A and 4B. This method is discussed here specifically with respect to 4" diameter PVC pipe. FIG. 4A shows in cross section a 4.25" I.D. circular interior cutter 70 mounted on a shaft 74 or mandrel. A pair of 4" diameter, spaced cutter guides 78 are mounted on one end of the shaft 74 near the cutter 70. The guides 78 are inserted into the end of PVC pipe 82, and the shaft 74 is rotated by a suitable motor as the cutter 70 is pushed into the pipe, causing the cutter to cut away a band of the interior end of the pipe to create an annular recess. A tube stop 86 spaced from the cutter 70 limits the insertion of the tool into the pipe 82 to create a recess of the desired axial length, which is typically 1.5".

To cut away the corresponding portion on the exterior of a PVC pipe 82', the interior cutter 70 with the tube stop 86 is removed from the shaft 74, and an exterior cutter 90 shown in FIG. 4B is mounted on the shaft. The cutter guides 78 can then be inserted into the end of the pipe 82', allowing cutter teeth on the end of the exterior cutter 90 to cut away an annular recess on the exterior of the pipe 82', which is likewise typically 1.5". The end of pipe 82' will engage a tube stop 86' joined to the exterior cutter 90 to limit the axial length of the exterior cut.

Figure 5:
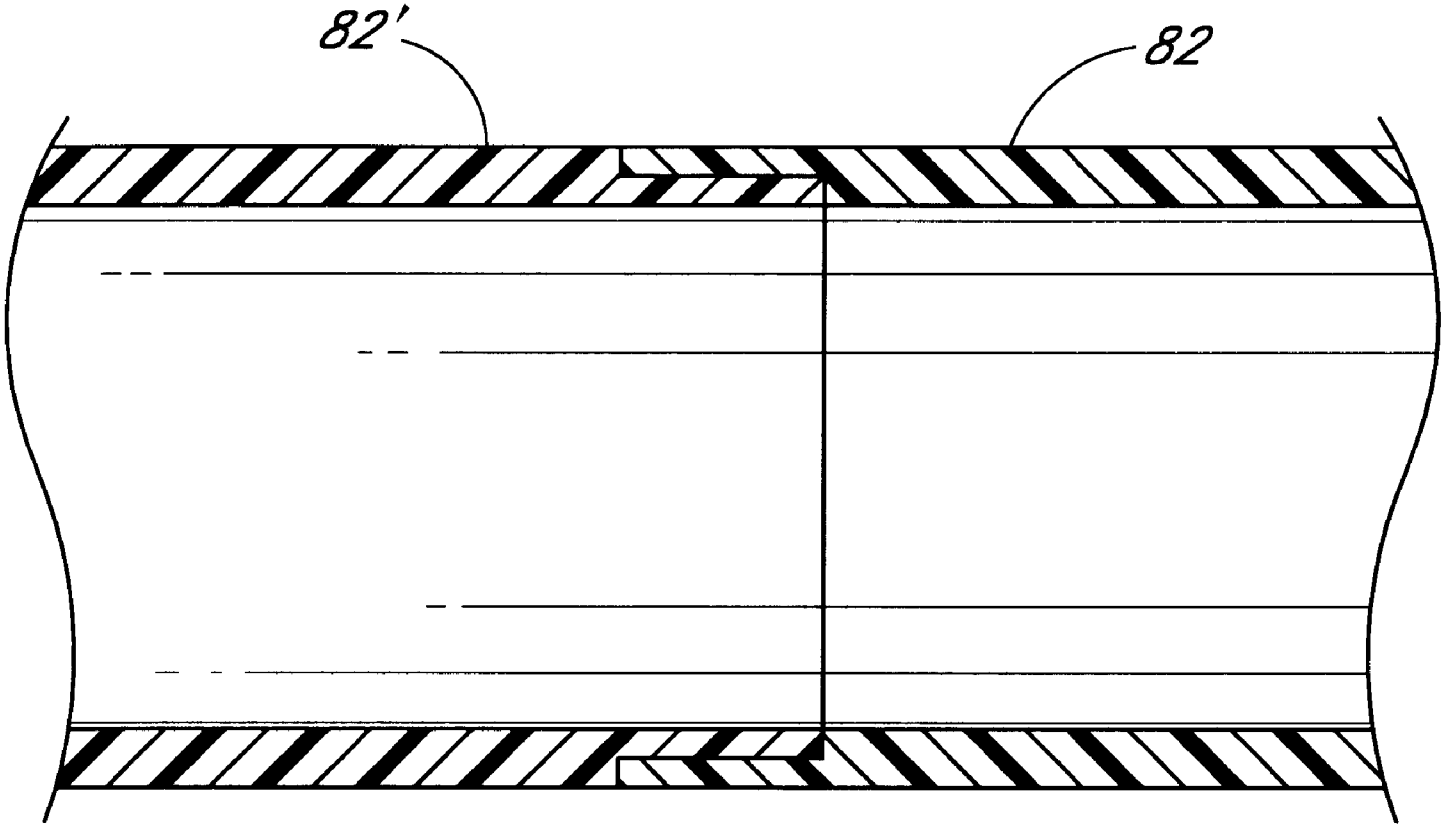
FIG. 5 is a longitudinal cross sectional view of two tubes, formed with the tools illustrated in FIGS. 4A and 4B, which mate to form a longer tube.
Figure 5:
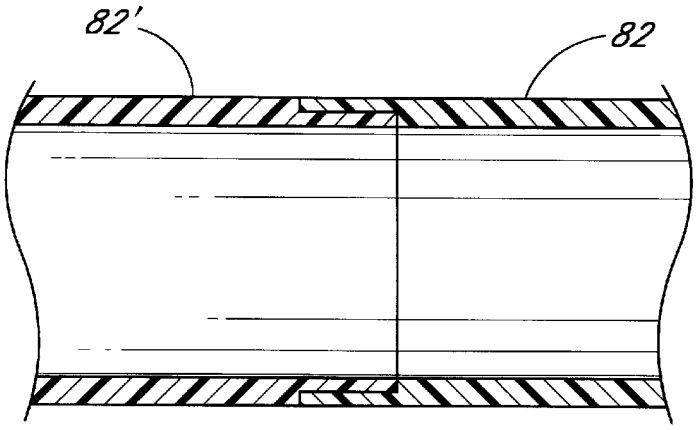
Figure 6:
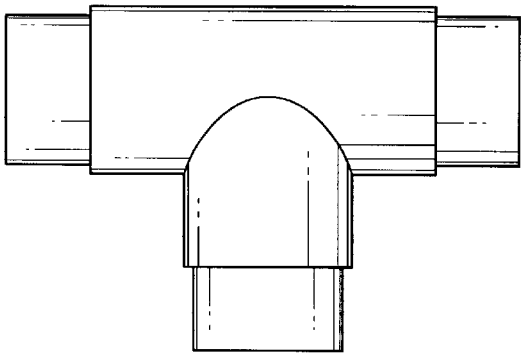
FIGS. 6–9 illustrate fittings to mate with the tubes of FIG. 5.
Figure 7:
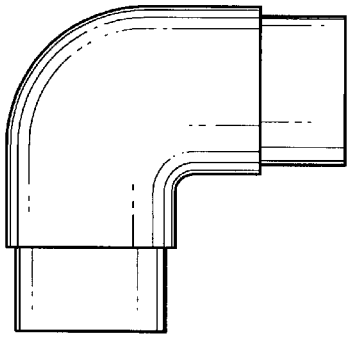
Figure 8:
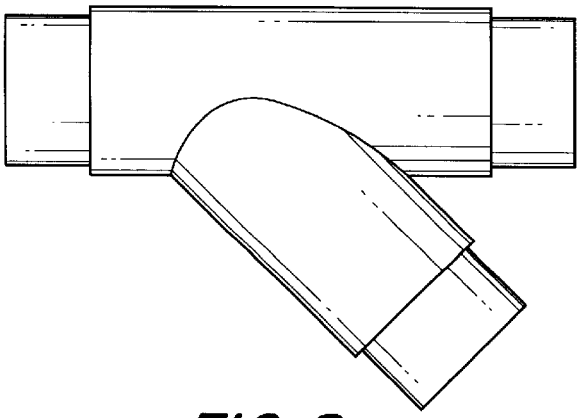
Figure 9:
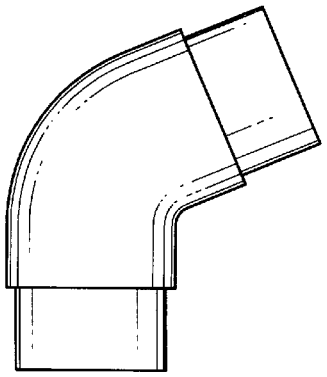

FIG. 5 illustrates how pipes 82 and 82' have been cut so that they fit together to form a longer unit. PVC pipes that have been so cut can be joined together using glue, such as that used for connecting plastic sprinkler pipe. The same cutting technique described herein can be used to construct a variety of shapes, including elbows and tees, and other couplings such as that illustrated in FIGS. 6–9. All necessary parts can be constructed from stock material, either on or off site. However, it is preferable that the fittings and couplings illustrated in FIGS. 1–9 be molded with the recessed ends shown. Of course, these components could have recessed interior ends rather than the exterior ones shown. This preferred fabrication technique facilitates construction of both a smooth, constant diameter inner and a smooth, constant outer surface. A smooth inner surface allows unobstructed water flow, while a smooth outer surface is aesthetically advantageous.

The invention may be embodied in other specific forms without departing from its spirit or essential characteristics.

The described embodiments are to be considered in all respects only as illustrative and not restrictive. The scope of the invention is therefore indicated by the appended claims rather than by the foregoing description. All changes which come within the meaning and range of equivalency of the claims are to be embraced within that scope.

What is claimed is:

1. A gutter system for receiving fluid run-off from a roof, said gutter system comprising:

an elongated tube having a longitudinal slot therein through which the fluid run-off enters, said slot being sized to receive an edge of the roof through said slot so that a portion of the roof resides within the interior of said tube;

at least one fastener for securing the position of said tube with respect to the roof to maintain the roof edge within the interior of said tube;

a second tube configured to be joined to the end of the elongated tube, said tubes having the same inner and outer diameter dimensions with one of said tubes having an outer diameter with an end recess portion and the other of said tubes having an inner diameter with an end recessed portion, configured to receive said outer diameter recess portion so that said tubes will have a smooth and substantially uninterrupted inner surface at the junction between the tubes and will also have a smooth and substantially uninterrupted exterior surface of the junction;

a debris collection spout connected to receive material from said elongated tube;

a removable element closing the lower end of the spout; and an overflow spout having an upper end connected to said debris spout in a manner such that substantially no material from said elongated tube enters said overflow spout until said debris spout is filled, and said overflow spout having a lower end permanently spaced from said debris collection spout.

2. The system of claim 1, in which said at least one fastener comprises a plurality of fasteners spaced along the length of said elongated tube with said fasteners extending through the elongated tube's exterior.

3. The system of claim 1, in which said elongated tube has a cross section which is substantially circular.

4. The system of claim 1, in which said tube comprises PVC pipe.

5. The system of claim 1, wherein the roof is substantially flat, said gutter system further comprising a plurality of flowtabs located between the roof and said tube to permit the fluid runoff to enter said tube between said flowtabs.

6. The system of claim 1, further comprising a screen between said debris spout and said overflow spout to keep debris within said debris spout.

7. A drainage system for a gutter, said system comprising:

a debris drainage down spout to collect material from a gutter attached to a roof;

a removable element closing a lower end of said spout; and an overflow drainage spout having an upper end connected to said debris spout so that substantially all material from the gutter flows into said debris spout until said debris spout has filled, said overflow drainage spout having a lower end permanently spaced from said debris spout so that after said debris spout has filled to the point where it is connected to said overflow drainage spout, water flows through said overflow drainage spout and away from said debris spout.

8. The system of claim 7, wherein said overflow spout includes a laterally extending section on its upper end, said section connected to said debris spout on one end and to a downwardly extending section of said overflow spout.

* * * * *